United States Patent [19]

Inagaki et al.

[11] Patent Number: 4,810,461

[45] Date of Patent: Mar. 7, 1989

[54] ZIRCONIUM-BASED ALLOY WITH HIGH CORROSION RESISTANCE

[75] Inventors: Masahisa Inagaki, Hitachi; Iwao Takase, Ibaraki; Masayoshi Kanno, Kitaibaraki; Jiro Kuniya, Hitachi; Kimihiko Akahori, Katsuta; Isao Masaoka, Hitachi; Hideo Maki, Katsuta; Junjiro Nakajima, Hitachi, all of Japan

[73] Assignee: Hitachi, Ltd., Tokyo, Japan

[21] Appl. No.: 940,723

[22] Filed: Dec. 9, 1986

[30] Foreign Application Priority Data

Dec. 9, 1985 [JP] Japan ..... 60-274927

[51] Int. Cl.[4] ..... G21C 3/06

[52] U.S. Cl. ..... 376/457; 376/451; 420/422

[58] Field of Search ..... 376/451, 457; 420/422

[56] References Cited

U.S. PATENT DOCUMENTS 4,003,788 1/1977 Boyko ..... 376/451

4,664,727 5/1987 Inagaki ..... 148/407

*Primary Examiner*—Donald P. Walsh

*Attorney, Agent, or Firm*—Antonelli, Terry & Wands

[57] ABSTRACT

A zirconium-based alloy with a high corrosion resistance, consisting essentially of 1 to 2 wt % Sn, 0.20 to 0.35 wt % Fe, 0.03 to 0.16 wt % Ni and the balance substantially Zr. The Fe/Ni content ratio of the alloy ranges between 1.4 and 8. The structure of the alloy has fine intermetallic compound of Sn and Ni is precipitated within the zirconium crystal grain of α-phase. The alloy may further contain 0.05 to 0.15 wt % Cr. This alloy exhibits reduced hydrogen absorption rate and suffers from no nodular corrosion, so that it can suitably be used as a material of nuclear fuel cladding tubes. The nuclear fuel cladding tube made of this alloys exhibits extended service life when used in a nuclear reactor of high degree of burn-up.

8 Claims, 5 Drawing Sheets

ZIRCONIUM-BASED ALLOY WITH HIGH CORROSION RESISTANCE

BACKGROUND IF THE INVENTION

1. FIELD OF THE INVENTION

The present invention relates to a novel zirconium-based alloy and, more particularly, to a zirconium-based alloy which is suitable for use as a material of fuel cladding tubes in a nuclear reactor, having superior corrosion resistance to withstand the use at high degree of burn-up of the fuel in the nuclear reactor. The invention is concerned also with a nuclear fuel rod having a cladding tube made of the zirconium-based alloy, as well as a nuclear fuel assembly having such fuel rods.

2. DESCRIPTION OF THE PRIOR ART

Among various known zircaloys, most commonly used as the material of a nuclear fuel cladding tube are zircaloy-2 (Sn: 1.20–1.70 wt %, Fe: 0.07–0.20 wt %, Cr: 0.05-0.15 wt %, Ni: 0.03–0.08 wt %, O: 900–1500 ppm and the balance substantially Zr, where (Fe+Cr+Ni): 0.16–0.24 wt %), and zircaloy-4 (Sn: 1.20–1.70 wt %, Fe: 0.18–0.24 wt %, Ni: 0.007 wt % or less, O: 900–1500 ppm, and the balance substantially Zr, where (Fe+Cr): 0.28–0.37 wt %).

The history of development of these zircaloys is described in detail in an article in ASTM, STP No. 368 (1963), pages 3–17. This article also introduces various other zircaloys such as zircaloy-1 (Zr-2.5 wt % Sn), zircaloy-3A (Zr-0.25 wt % Sn-0.25wt % Fe), zircaloy-3B (Zr0.5 wt % Sn-0.4 wt % Fe), zircaloy-3C (Zr-0.5 wt % Sn-0.2 wt % Fe-0.2 wt % Ni), and zircaloy-2 (Sn: 1.20–1.70 wt %, Fe: 0.12–0.18 wt %, Cr: 0.05–0.15 wt %, Ni: 0.007 wt % or less).

These zircaloys other than the zircaloy-2 and zircaloy-4 suffer from the following disadvantages.

The zircaloy-1, which does not contain Fe, Cr and Ni, show only a low level of corrosion resistance. The zircaloys-3A–3C are intended for higher producibility through reduction of the Sn content, as well as for higher corrosion resistance through increasing the Fe and Ni contents. These zircaloys-3A–3C, however, show a low level of strength, that is, about 75% of that exhibited by the zircaloy-2. A Ni-free zircaloy-2 show only small corrosion resistance in 510° C. steam, due to elimination of Ni content. The zircaloy-4 is an alloy which is obtained by increasing the Fe content in the Ni-free zircaloy-2. This alloy, however, has to have a large Fe content due to the elimination of Ni content, with the result that the neutron absorption cross section is increased undesirably.

According to the article mentioned above, the components of the zircaloys have the following functions or effects. Sn is added for the purpose of improving the mechanical properties of the alloy and eliminating unfavorable effect on the corrosion resistance which may otherwise be caused by nitrogen contained in sponge zirconium used as a raw material for producing the zircalloys. Fe, Cr and Ni are added mainly for the purpose of improving the corrosion resistance. Discussion is made in the article as to the corrosion resistance in high temperature water of 315° to 360° C. and in steam of 400° C. with respect to ternary alloys produced by adding a single element of Fe or Cr or Ni to each of Zr-2.5 wt % Sn alloy and Zr-1.8 wt % Sn alloy as well as binary alloys produced by adding a single element of Fe or Cr or Ni to Zr. The conclusion is that the optimum contents of Fe, Cr and Ni, when each of them is added as a single additive, are 0.22 wt %, 0.1 wt % and 0.22 wt %, respectively. Discussion is made also in regard to the effect of addition of Fe, Cr and Ni in combination. The article reports that the optimum total content of Fe, Cr and Ni is 0.35 wt % in a case of the steam of 400° C. and is 0.3 wt % in another case of the water of 360° C. The alloy compositions of the zircaloy-2 and zircaloy-4, which are presently used commonly, have been determined through the discussion explained above.

Thus, high levels of corrosion resistance of the zircaloy-2 and zircaloy-4 have been confirmed. However, ASTM, STP No. 633 (1977) pages 236–280 and pages 295–311 states that, when the zircaloy-2 and the zircaloy-4 with confirmed high corrosion resistance are used in a boiling water reactor, a papular local corrosion is observed to occur on the members made of these alloys. This local corrosion is generally known as nodular corrosion. As the high degree of burn-up of nuclear fuel is effected, areas suffering from the nodular corrosion are increased to connect one another and finally exfoliate from the material. Thus, the prevention of the nodular corrosion becomes essential to the operation of nuclear reactor with high degree of burn-up of the nuclear fuel.

ANS TRANSACTION Vol. 34 (June 1980) pages 237–238, J. Electrochem. Soc. Electrochemical Science and Technology, February 1975, pages 100–204, as well as Japanese Patent Laid-Open No. 95247/1983, state that the nodular corrosion which generally takes place in nuclear reactor can be well reproduced in an accelerated corrosion test conducted outside the reactor by using high temperature steam atmosphere of about 500° C. or higher. In other words, it has been confirmed that the sensitivity of the zircaloy to the nodular corrosion cannot be evaluated through a test conducted in high temperature steam of 400° C. or in high temperature water of 315° to 360° C. Corrosion test conducted under such an improved testing condition, i.e., within the atmosphere of high temperature steam of 500° C. or higher, proved that even the zircaloys-2 and -4 are not sufficiently resistant to nodular corrosion. This in turn has given a rise to the demand for cladding tubes having higher resistance to nodular corrosion.

The specification of U.S. Pat. No. 2,772,964 discloses an alloy consisting of 0.1 to 2.5 wt % of Sn, not greater than 2 wt % of at least one of Fe, Cr and Ni, and the balance substantially Zr, but fails to disclose any alloy which is superior regarding both corrosion resistance and hydrogen absorption characteristics.

Japanese Unexamined Patent Publication Nos. 110411/1976, 110412/1976 and 22364/1983 disclose a heat-treating method known as $\beta$ quench for improving corrosion resistance of zircaloy, and also a process which comprises the $\beta$ quench step. Briefly, the $\beta$ quench method is a heat-treating method in which a zircaloy is quenched from a temperature range of $\alpha+\beta$ phases or $\beta$-phase alone. This treatment causes refining or partial solid-solution of intermetallic compound phases such as ($Zr(Cr, Fe)_2$, $Zr_2(Ni, Fe)$, etc.) which are precipitated in the alloy. It is true that the $\beta$-quenched zircaloy exhibits improved corrosion resistance, but the zircaloy of as $\beta$-quenched state exhibits a low ductility due to the fact that it contains martensitic structure (acicular structure) which has super-saturated solid solution of Fe, Cr and Ni.

In order to improve the ductility of the zircaloy, therefore, it has been proposed to subject the zircaloy to a process in which a cold working and annealing are repeated alternatingly after the $\beta$ quenching, so as to obtain a recrystallized structure.

For instance, in the case of production of a nuclear fuel cladding tube, an ingot formed from a molten material is formed into a cylindrical billet through hot forging conducted at about 1000° C., a solid-solution treatment conducted at about 1000° C., hot forging conducted at about 700° C. and hot extrusion. The billet is then subjected to $\beta$ quench followed by three repetitions of the alternating steps of Pilger mill cold rolling and annealing. If the steps of intensive working and annealing are repeated a plurality of times after the $\beta$ quenching, a coarse intermetallic compound phase will be caused in a zircaloy alloy having been improved to have high corrosion resistance by the $\beta$-quenching, so that the corrosion resistance thereof becomes degraded.

Thus, it is desired that a zirconium based alloy used as a fuel cladding tube has a high corrosion resistance which does not vary when it is subjected to working and heat treatment.

The conventional methods described hereinabove for improving the corrosion resistance of zircaloy rely upon heat treatments, and no consideration has been made for the purpose of prevention of nodular corrosion through reconsideration of alloy composition. The conventional methods, therefore, could not completely prevent the nodular corrosion from occurring in a cladding tube used in the actual nuclear reactor. In addition, these known methods could not sufficiently reduce hydrogen absorption rate by the zircaloy.

SUMMARY OF THE INVENTION

Accordingly, an object of the present invention is to provide a zirconium-based alloy which is free from the problem of nodular corrosion and which exhibits improved hydrogen absorption property (small hydrogen absorption rate, as well as a method of producing such a zirconium-based alloy. The invention also aims at providing both a nuclear fuel rod and a fuel assembly which incorporate members made of such a zirconium-based alloy.

To this end, according to the present invention, there is provided a zirconium-based alloy having high corrosion resistance consisting essentially of 1 to 2 wt % of Sn, 0.20 to 0.35 wt % of Fe, 0.03 to 0.15 wt % of Ni and the balance substantially Zr, the ratio of Fe/Ni contents being in a range between 1.4 and 8, and fine intermetallic compound of Sn and Ni being precipitated in the $\alpha$-phase zirconium crystal grains.

According to the invention, a further improvement in the corrosion resistance can be achieved by addition of 0.05 to 0.15 wt % of Cr.

In order to obtain an appreciable improvement in the corrosion resistance, as well as the strength, it is essential that the Sn content is 1 wt % or greater. However, increase of the Sn content beyond 2 wt % does not produce any remarkable effect in the improvement of the corrosion resistance but, rather, causes a reduction in the plastic workability. The Sn content, therefore, should not exceed 2 wt %. Preferably, the Sn content is in the range of 1.2 to 1.7 wt % in view of the compatibility of high workability, superior strength and improved corrosion resistance.

Fe is an element which improves the corrosion resistance of the zirconium-based alloy in high temperature and high pressure water, and which improves hydrogen absorption characteristics and strength. In order to obtain an appreciable effect, the Fe content should be at least 0.2 wt %. An Fe content exceeding 0.35 wt %, however, increases the neutron absorption cross section and degrades cold workability. The Fe content, therefore, should not exceed 0.35 wt %. Good compatibility of various properties is obtained preferably when the Fe content ranges between 0.2 and 0.3 wt %. A zirconium-based alloy having Fe content falling within the range specified above is suitable for use in the production of thin-walled structural members such as nuclear fuel cladding tubes, spacers and channel boxes through repetition of cold plastic working and annealing.

Ni is an additive which can improve the corrosion resistance in high temperature and high pressure water without causing the hydrogen absorption rate to be increased substantially, the content of Ni being not less than 0.03 wt %. It is true that the corrosion resistance can be increased substantially by the addition of Fe alone. However, by adding Ni together with Fe, it is possible to remarkably reduce the amount of Fe to be added. However, since this element has a tendency to increase the hydrogen absorption rate, the content thereof should not exceed 0.15 wt %. High corrosion resistance and low hydrogen absorption rate are obtainable preferably when the Ni content ranges between 0.05 and 0.1 wt %.

The hydrogen absorption rate characteristic is significantly affected by the Fe/Ni content ratio. The hydrogen absorption rate is remarkably increased when the ratio has a value less than 1.4. On the other hand, the effect for reducing the hydrogen absorption rate is saturated when the ratio is increased beyond 8. The Fe/Ni content ratio, therefore, is selected between 1.4 and 8. Particularly, high corrosion resistance and low hydrogen absorption rate, as well as superior cold workability, are obtained preferably when the Fe/Ni ratio ranges between 2 and 4. The Fe/Ni content ratio has a significance particularly when the Fe content is 0.2 wt % or greater, and is closely related to the Ni content.

The intermetallic compound composed of Sn and Ni is indispensable for the improvement in the corrosion resistance. This intermetallic compound is obtained by quenching from the temperature at which the $\alpha$-phase and the $\beta$-phase coexists after the final hot working or by quenching from the $\beta$-phase temperature, and suppresses the growth of the Fe-Ni-Zr intermetallic compounds occurring in an annealing step effected thereafter which Fe-Ni-Zr intermetallic compounds tends to grow in the subsequent annealing, thus improving the corrosion resistance and the hydrogen absorption rate. Preferably, the $Sn_2Ni_3$ intermetallic compound has a particle size not greater than 0.2 $\mu$m.

According to another aspect of the present invention, there is provided a nuclear fuel assembly having a plurality of fuel rods, upper and lower tie-plates which hold both ends of the fuel rods, spacers for providing a predetermined pitch of array of the fuel rods arranged between the upper and lower tie-plates, a channel box having a polygonal tubular shape which receives the fuel rod, upper tie-plate, lower tie-plate and the spacers, and a handle means held on the upper tie-plate and allowing the fuel rods to be handled or transported as a unit, wherein the fuel rods are constituted by fuel cladding tubes made of the zirconium-based alloy having the above-described features which tubes receive nuclear fuel pellets therein.

Each fuel cladding tube, charged with the nuclear fuel pellets, is closed at its both ends by terminal plugs welded thereto after the tube is charged also with an inert gas. The terminal plugs also are made of a zirconium-based alloy prepared in accordance with the invention.

Preferably, the nuclear fuel cladding tube of the invention is made of the zirconium-based alloy of the invention by the steps of subjecting the alloy to a hot working, quenching it from the $(\alpha+\beta)$ phase temperature or $\beta$-phase temperature, and repeating the alternating treatments of cold working and annealing. Preferably, the quenching is conducted from the $(\alpha+\beta)$ phase temperature, because such quenching provides higher cold plastic workability than that obtained when the quenching is effected from the $\beta$-phase temperature.

The quenching from the $(\alpha+\beta)$ phase temperature or from the $\beta$-phase temperature is conducted preferably after hot plastic working but before the final plastic work, more preferably before the first cold plastic working.

The $(\alpha+\beta)$ phase temperature of the zirconium alloy of the invention is 825° to 980° C., while the $\beta$-phase temperature thereof is above 980° C. and not more than 1100° C. The quenching is preferably conducted by use of cooling water flowing in a crude tube or by applying water jet or spray. More specifically, the quenching is conducted preferably before the first cold plastic working by the steps of locally heating the tube and water-spraying the tube portion locally heated by the high frequency induction heating.

This quenching provides high ductility at the inner surface of the tube while providing low hydrogen absorption rate and high corrosion resistance at the outer surface of the tube.

More specifically, the $(\alpha+\beta)$ phase temperature from which the quenching is effected is preferably selected from a temperature range in which the $\alpha$-phase and the $\beta$-phase coexist but the $\beta$-phase predominantly exists. The property of $\alpha$-phase does not substantially vary by quenching and exhibits low hardness and high ductility, whereas the quenching of the zerconium alloy from the $\beta$-phase forms acicular phase having high hardness but reduces cold workability. However, the existence of $\alpha$-phase mixed with the $\beta$-phase can bring about a high cold workability high corrosion resistance and low hydrogen absorption rate even when the amount of the $\alpha$-phase is small.

Preferably, the quenching is conducted after heating the alloy at a temperature at which the $\beta$-phase occupies 50 to 95% in terms of area ratio. The heating is conducted in a short time within 5 minutes, preferably in 1 minute, because a long heating time undesirably causes growth of the crystal grains, resulting in a reduced ductility.

Preferably, the annealing temperature ranges between 500° and 700° C., more preferably between 550° and 640° C. A high level of corrosion resistance is obtained particularly when the annealing is effected at a temperature below 640° C. It is also preferred that the heating for annealing is conducted in a high degree of vacuum. The degree of the vacuum preferably ranges between $10^{-4}$ and $10^{-5}$ torr. The annealing is preferably effected such that the annealed alloy has no substantial oxide film and shows a colorless metallic luster. The annealing period of time is preferably between 1 and 5 hours.

The welding can be conducted by various welding methods such as, for example, TIG welding, laser beam welding and electron beam welding, among which TIG welding used preferably. It is also preferred that both the tubular body and the terminal plugs of the cladding tube are made of the zirconium-based alloy having the same composition, and the inert gas is charged at a pressure of 1 to 3 atm. The welded portions are used without requiring any additional treatment.

The selection of the material of the unclear fuel cladding tube requires consideration of the hydrogen absorption rate characteristic, mechanical property, neutron absorption characteristic and the producibility, in addition to the corrosion resistance.

(Corrosion Resistance)

The oxide film on the surface of a zircaloy is a n-type semiconductor with excess metal-type (oxygen deficiency type), the chemical composition thereof being deviated from the stoichiometric composition and being expressed by $ZrO_{2-x}$. The excess metallic ions are compensated for by equivalent electrons, while the oxygen deficiency portion exists as an anionic defect within the oxide film. The oxygen ions are gradually diffused into the oxide film while replacing the positions thereof with the anion defects and forms new oxide upon combining with zirconium at an interface defined between the oxide film and the alloy, so that the corrosion gradually penetrates into the alloy. As this oxidation proceeds over the entire surface of the cladding tube, a strong and chemically stable oxide film having so-called "passive" state is formed on the tube surface, and the rate of growth of the oxide film is gradually lowered as the time elapses, whereby the oxide film becomes to serve as an anti-corrosion film which resists the tendency of corrosion of the cladding tube.

The Zr ion positions in the $ZrO_{2-x}$ ion lattice are replaced by Fe and Ni which are the alloy elements, thus forming anion defects. Fe and Ni, however, produces an effect to make the rate of growth of the oxide film uniform when they are distributed uniformly, thus enabling a uniform protective film to be formed.

The $\beta$-quench in the production process has an effect to uniformalize the distribution of the alloy elements. Any heat treatment in the $\alpha$-phase temperature such as annealing promotes the precipitation of intermetallic compounds and coarsens the precipitated intermetallic compound. The precipitation of the intermetallic compound in turn causes lack of alloy elements in the region where the precipitation has occurred, resulting in a non-uniform rate of growth of the oxide film. This in turn causes a non-uniform distribution of stress in the oxide film, often resulting in cracking of the oxide film. Thus, since the zircaloy is directly contacted by the corrosive atmosphere through the cracks, local corrosion of the zircaloy, i.e., nodular corrosion, is caused undesirably.

In order to prevent the nodular corrosion from occurring, therefore, it is necessary that Fe and Ni are uniformly distributed by quenching from the $(\alpha+\beta)$ phase or from the $\beta$-phase, and that the contents of Fe and Ni are large enough to prevent substantial reduction in the concentration apt to occur due to precipitation. In particular, Ni is an element essential for the prevention of nodular corrosion, because it tends to be dispersed uniformly in the crystal grains in the form of fine intermetallic compound phase, $Sn_2Ni_3$, having a size of 0.01 μm, as a result of the quenching mentioned above.

However, the $Sn_2Ni_3$ intermetallic compound tends to be changed into $Zr_2(Ni \bullet Fe)$ when the alloy is annealed for a long period of time at a high temperature level, with a result that the corrosion resistance is undesirably lowered.

The $\alpha+\beta$ quenching or the $\beta$ quenching is a step indispensable to the invention which step is effected after the final hot working. Further, in a case where a hot working is effected after this $\alpha+\beta$ or $\beta$ quenching, a heating temperature of the hot working be not more than 640° C. and preferably 400° to 640° C.

It is, therefore, necessary that the conditions for the heat treatment is determined in such a manner that the Sn.Ni intermetallic compound does not have a size greater than 0.2 μm.

(Hydrogen absorption rate)

Since hydrogen makes the material embrittle, the hydrogen absorption rate is necessary to be small. As stated before, Ni has a tendency to increase the hydrogen absorption rate, although it is an essential element for improving the corrosion resistance. The hydrogen gas is a product of oxidation or corrosion. Namely, the smaller the degree of oxidation, the smaller the rate of generation of hydrogen gas. In the oxide film, electrons move in the direction counter to the direction of internal diffusion of the oxygen ions so that the hydrogen ions are reduced by the eletrons to become hydrogen gas. A part of the hydrogen gas is absorbed by the alloy to form hydrides which causes hydrogen embrittlement. The presence of an intermetallic compound of $Zr_2(Ni, Fe)$ type promotes the cathode polarization reaction to increase the hydrogen absorption rate. However, if an intermetallic compound of $Zr(Cr, Fe)_2$ or $ZrFe_2$ type exists together with the above-mentioned intermetallic compound, the cathode polarization reaction is suppressed. It is, therefore, necessary to add Fe by an amount not smaller than a predetermined amount not smaller than 0.2 wt %.

If fine precipitate of $Sn_2Ni_3$ is formed by $\alpha+\beta$ quenching or $\beta$ quenching, the amount of $Zr_2(Ni \bullet Fe)$ precipitate is reduced, with the result that the hydrogen absorption rate is reduced. Heat-treatment and/or hot working at a temperature 700°-800° C. which is effected after the $\alpha+\beta$ or $\beta$ quenching and which forms $Zr_2(Ni \bullet Fe)$ precipitate is not preferred, and the heat-treatment and/or hot working be effected at a temperature not more than 640° C.

(Neutron Absorption Cross Section)

Fe and Ni have greater neutron absorption cross section than Zr. Excessive contents of Fe and Ni, therefore, are not preferred from the view point of power generating efficiency, because Fe and Ni absorb thermal neutrons which contribute to the power generation.

In order to obtain a neutron absorption cross section equivalent to that of conventionally used zircaloy, the Ni and Fe contents are preferably selected to be not greater than 0.3 wt % and not greater than 0.05 wt %, respectively. It is thus necessary that the Fe and Ni contents are selected to meet the following conditions.

$$0.55 \times \text{Ni content} + 0.3 \times \text{Fe content} \leqq 0.165$$

(Producibility and Mechanical Property)

Reduction in hot and cold workability causes cracking of the alloy during working. The addition of Ni permits precipitation of $Zr_2(Ni, Fe)$ type intermetallic compound. The Sn.Ni intermetallic compound, which appreciably contributes to the improvement in the corrosion resistance, is not coarsened by a heat treatment in the α-phase temperature, while the $Zr_2(Ni, Fe)$ type intermetallic compound is coarsened by such heat treatment to thereby reduce the workability. In order to prevent this intermetallic compound from being coarsened, it is preferred to maintain the Ni content to be 0.2 wt % or less and to make the size of this compound fine by β-quench or $\alpha+\beta$ quenching.

The above requirements apply also to the mechanical properties. Namely, ductility is reduced by excessive addition of Ni. The reduction in ductility is serious when 3.0% or greater of Sn is added in the alloy.

DESCRIPTION OF THE PREFERRED EMBODIMENTS

Figure 1:
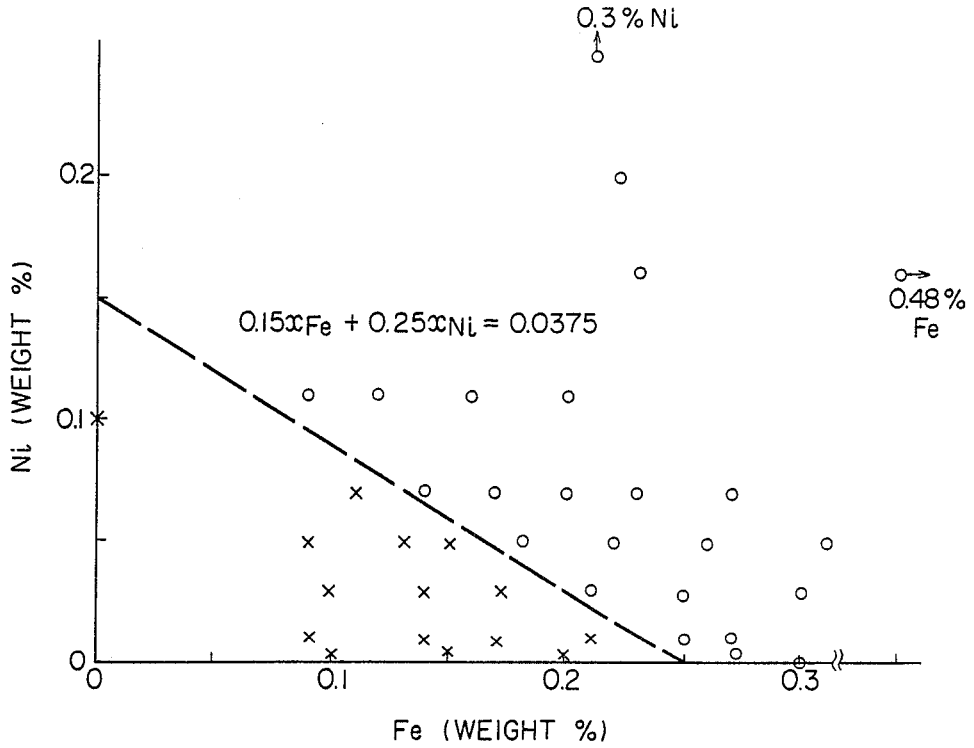
FIG. 1 is a graph illustrating the influence of the Fe and Ni contents in alloy with respect to the occurrence of nodular corrosion.

Ingots of alloys having compositions shown in Table 1 in terms of weight percents were prepared by vacuum arc melting, using zirconium sponges for nuclear reactors as a raw material to be melted. In each composition, the balance is substantially Zr.

TABLE 1

| No. | Sn | Fe | Ni | Cr | Fe/Ni |
|---|---|---|---|---|---|
| 1 | 1.5 | 0.10 | — | 0.10 | — |
| 2 | " | 0.15 | — | " | — |
| 3 | " | 0.20 | — | " | — |
| 4 | " | 0.27 | — | " | — |
| 5 | 1.5 | 0.09 | 0.01 | 0.13 | 9 |
| 6 | " | 0.14 | " | " | 14 |
| 7 | " | 0.17 | " | " | 17 |
| 8 | " | 0.21 | " | " | 21 |
| 9 | " | 0.25 | " | " | 25 |
| 10 | " | 0.27 | " | " | 27 |
| 11 | 1.5 | 0.10 | 0.03 | 0.11 | 3.3 |
| 12 | " | 0.14 | " | " | 4.7 |
| 13 | " | 0.17 | " | " | 6.3 |
| 14 | " | 0.21 | " | " | 7.0 |
| 15 | " | 0.25 | " | " | 8.3 |
| 16 | " | 0.30 | " | " | 10 |
| 17 | 1.5 | 0.09 | 0.05 | 0.09 | 1.8 |
| 18 | " | 0.13 | " | " | 2.6 |
| 19 | 1.5# | 0.15 | 0.05# | 0.09# | 3.0 |
| 20 | 1.5 | 0.18 | 0.05 | 0.09 | 3.6 |
| 21 | " | 0.22 | " | " | 4.4 |
| 22 | " | 0.26 | " | " | 5.2 |
| 23 | " | 0.31 | " | " | 6.2 |
| 24 | 1.5 | 0.11 | 0.07 | 0.11 | 1.6 |

TABLE 1-continued

| No. | Sn | Fe | Ni | Cr | Fe/Ni |
|---|---|---|---|---|---|
| 25 | " | 0.14 | " | " | 2.0 |
| 26 | " | 0.17 | " | " | 2.4 |
| 27 | " | 0.20 | " | " | 2.9 |
| 28 | " | 0.23 | " | " | 3.3 |
| 29 | " | 0.27 | " | " | 3.9 |
| 30 | 1.5 | 0.09 | 0.11 | 0.09 | 0.8 |
| 31 | " | 0.12 | " | " | 1.1 |
| 32 | " | 0.16 | " | " | 1.5 |
| 33 | " | 0.20 | " | " | 1.8 |
| 34 | " | 0.25 | " | " | 2.3 |
| 35 | 1.5 | 0.23 | 0.16 | 0.11 | 1.4 |
| 36 | " | 0.22 | 0.20 | 0.08 | 1.1 |
| 37 | " | 0.21 | 0.30 | 0.12 | 0.7 |
| 38 | " | 0.48 | 0.16 | 0.10 | 3.0 |

Each ingot was hot-rolled at 700° C., annealed at 700° C. for 4 hours, held at $(\alpha+\beta)$ phase temperature region (900° C.) and $\beta$-phase temperature region (1000° C.) for 5 minutes and then water-quenched. Subsequently, the ingot was formed into a sheet of 1 mm thick, through three repetitional cycles of treatment, each cycle including cold rolling (working ratio 40%) and 2-hours intermediate annealing at 600° C. The sheet was subjected to 2-hour annealing conducted at $\alpha$-phase temperature region (530°, 620°, 730° C.) above the recrystallization temperature, and the annealed sheet was subjected to a corrosion test. The corrosion test was conducted in steam maintained at a pressure of 10.3 MPa. The testing temperature and the testing time were selected in accordance with the method disclosed in Japanese Unexamined Patent Publication No. 95247/1983 which proposes conditions for reproducing the nodular corrosion in boiling water reactor.

Namely, the test piece was held in steam of 410° C. for 8 hours and then the steam temperature was raised to 510° C. while the pressure was maintained unchanged. The test piece was held in the steam of 510° C. for 16 hours.

The hydrogen absorption rate was evaluated in accordance with the following method:

When the test piece was maintained in the steam, a reaction took place in accordance with the formula described below, generating oxide $ZrO_2$ and hydrogen gas.

$$Zr+2H_2O \rightarrow ZrO_2+2H_2$$

By measuring the increment of weight attributable to oxidation, it is possible to know the number of mols of water which have reacted with the zircaloy and, hence, the number of mols of hydrogen generated through the oxidation reaction. In the test, the amount of hydrogen contained in the test piece after the corrosion test was measured through chemical analysis and the number of mols of hydrogen absorbed was calculated on the basis of the measured amount of hydrogen. Then, the hydrogen pick-up fraction was determined as the ratio of the amount of hydrogen absorbed to the amount of hydrogen generated.

FIG. 1 shows the influence of the Fe and Ni contents (wt %) on the generation of nodular corrosion. Marks O represent that nodular corrosion was not observed on the major surfaces nor on the side and end surfaces of the test piece, while the weight increment due to nodular corrosion is not greater than 45 mg/dm$^2$, regardless of the temperature of the final annealing. On the other hand, marks X represent that test piece showed a nodular corrosion in its major surfaces or end or side surfaces with corrosion weight increment exceeding 50 mg/dm$^2$. From FIG. 1, it will be seen that the nodular corrosion can be prevented when the alloy composition has high Ni and Fe contents existing in the upper side of a broken-line curve which represents a composition expressed by $0.15Fe+0.25Ni=0.0375$.

Figure 2:
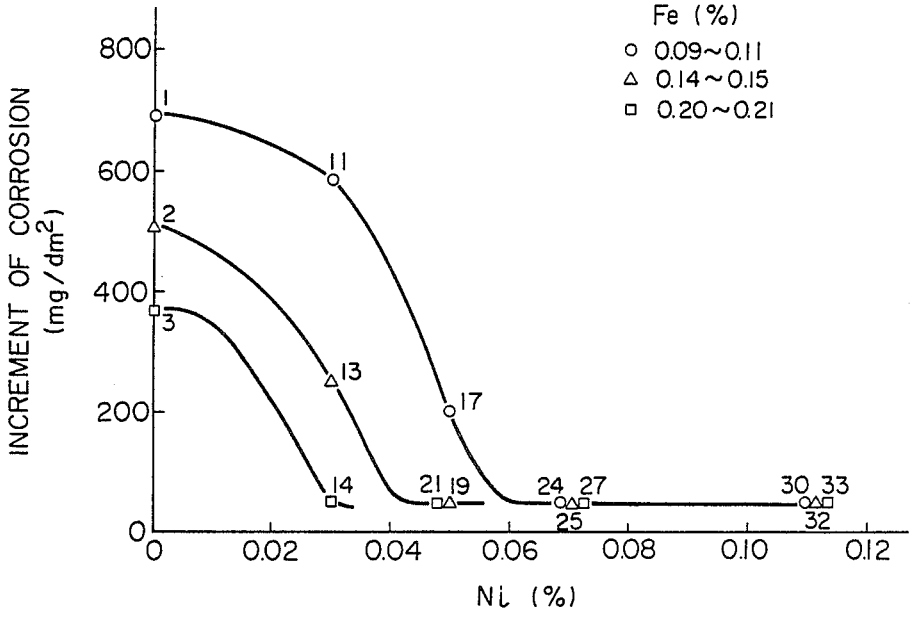
FIG. 2 is a graph illustrating the influence of Ni content on the corrosion weight gain.

FIG. 2 is a diagram illustrating the influence of Fe and Ni contents on the weight increment due to corrosion. As will be seen from this Figure, the corrosion in the water of high temperature and pressure can be remarkably suppressed by increment of Fe and Ni contents. In particular, addition of Ni is effective, and the weight increment due to corrosion is drastically decreased even by addition of a trace amount of Ni. It was confirmed that the weight increment due to corrosion was maintained below 45 mg/dm$^2$ and no nodular corrosion was observed when Ni was added by 0.03 wt % in the presence of about 0.2 wt % of Fe.

Figure 3:
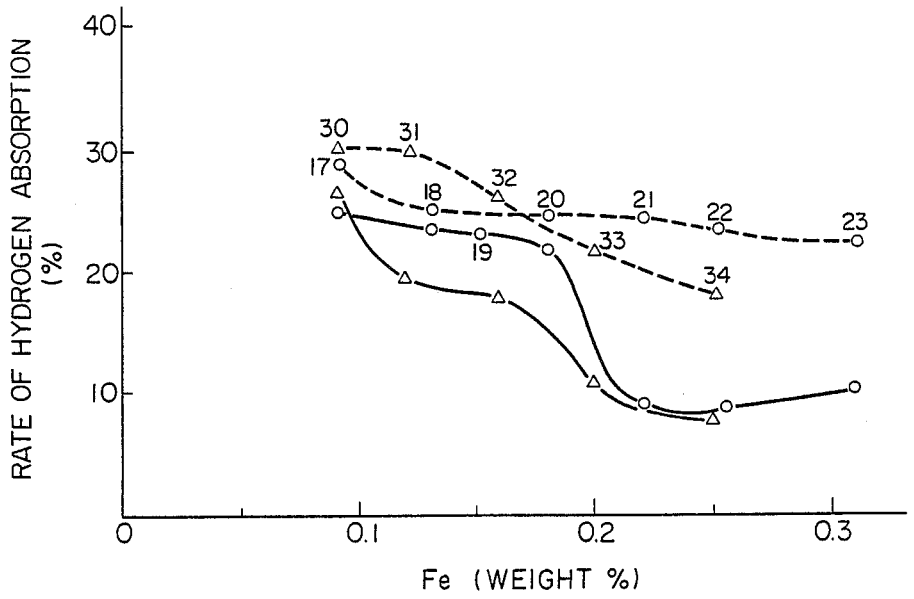
FIG. 3 is a graph illustrating the influence of Fe content on hydrogen absorption rate.

FIG. 3 shows the influence of Fe content on the hydrogen pick-up fraction. Marks Δ show the rates of hydrogen pick-up fraction exhibited by an alloy containing 0.11 wt % of Ni, while marks O show those exhibited by an alloy containing 0.05 wt % of Ni. The broken line curves show the hydrogen pick-up fraction as observed when the $(\alpha+\beta)$ quench or the $\beta$-quench was omitted, while the solid-line curves show the result as observed when the step of $(\alpha+\beta)$ quench was taken. From this Figure, it will be seen that the hydrogen pick-up fraction can be reduced to a level below 11% by the adoption of the $(\alpha+\beta)$ quench.

Figure 4:
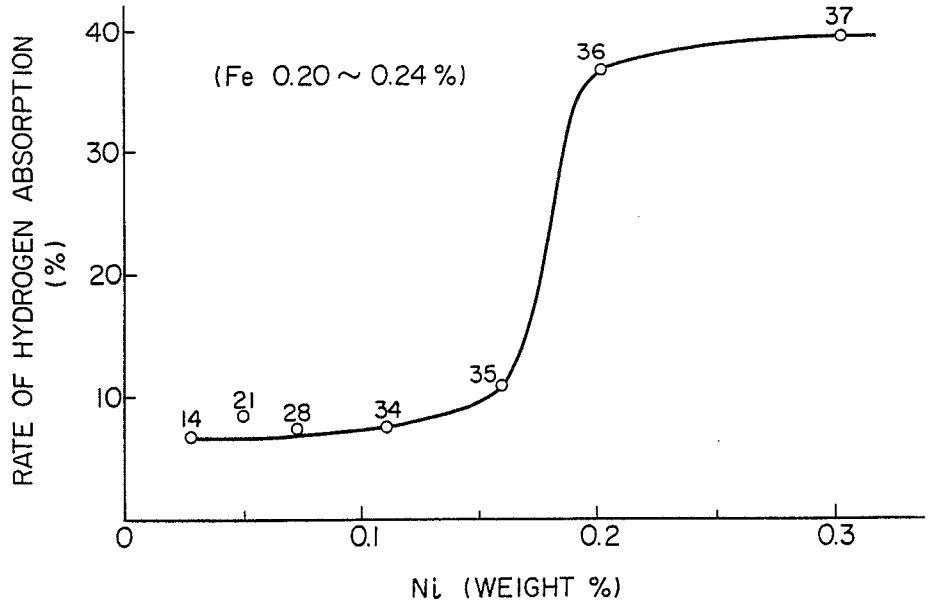
FIG. 4 is a graph illustrating the influence of Ni content on hydrogen pick-up fraction.

FIG. 4 shows the influence of Ni content on the hydrogen absorption rate, when the Fe content ranges between 0.20 and 0.24 wt %. It will be seen that the hydrogen absorption rate is as small as 11% or less, when the Ni content does not exceed 0.16 wt %, but is drastically increased and becomes 40% when the Ni content is increased beyond 0.2 wt %. Therefore, the Ni content is preferably selected to be 0.16 wt % or less.

Figure 5:
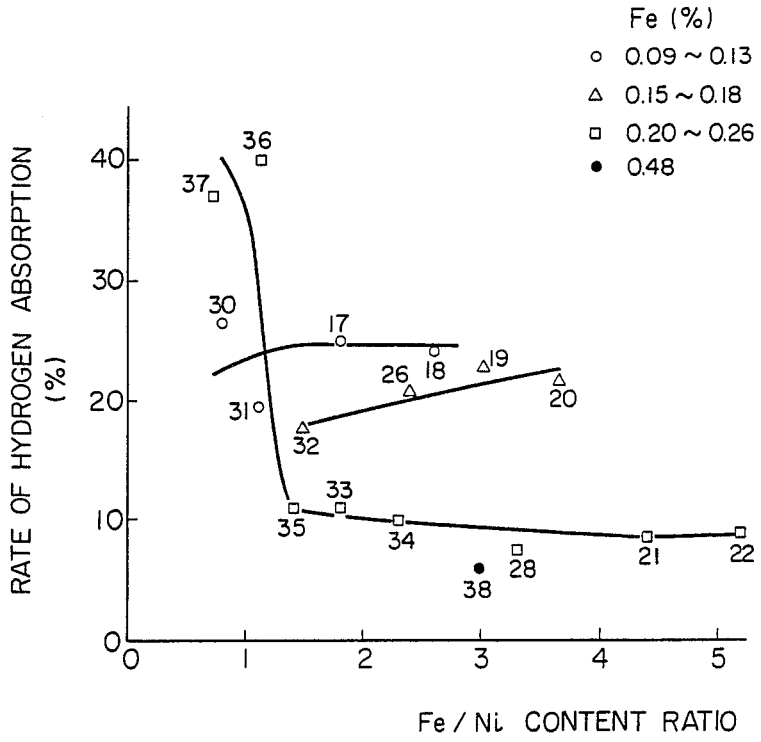
FIG. 5 is a graph illustrating the influence of Fe/Ni ratio on hydrogen pick-up fraction.

FIG. 5 shows how the hydrogen absorption rate is influenced by Fe/Ni content ratio. As marked by O and Δ, the hydrogen absorption rate is not changed significantly when the Fe content does not exceed 0.20 wt %. However, when the Fe content exceeds 0.20 wt %, the hydrogen absorption rate is drastically lowered by selecting the Fe/Ni ratio to be 1.4 or greater. The inventors have found that, since Fe and Ni exhibit contrary effects in so far as the hydrogen absorption rate is concerned as stated before, the Fe/Ni content ratio has a great significance in the reduction of the hydrogen absorption rate. Although the Fe/Ni content ratio does not have any substantial influence thereon when the Fe content is less than 0.2 wt % and when the Ni content is more than 0.2 wt %, the Fe and Ni become having an intimate correlation with each other regarding the improvement of hydrogen absorption rate when the contents of Fe and Ni are not less than 0.2 wt % and not more than 0.2 wt %, respectively.

The alloy of the sample No. 38 was prepared by increasing the Fe content to 0.48 wt %. This alloy showed corrosion weight increment of 43 mg/dm$^2$ and hydrogen absorption rate of 12%. This means that, from the view point of corrosion resistance and hydrogen absorption rate, the Fe content may be increased to a level above 0.2 wt % up to about 0.5 wt %, when the Ni content is below 0.16 wt %.

However, as will be explained later, the cold plastic workability is seriously reduced when the sum of the contents of Ni and Fe becomes 0.64 wt %, so that it is not recommended to increase the Ni and Fe contents unlimitedly particularly when the material is intended for use in a thin-walled structure which is produced by a cold plastic working. The sum of Fe and Ni contents should be 0.40 or less.

The alloy of the sample No. 34, formed through quenching from $(\alpha+\beta)$ phase temperature, was observed by a transmission electron microscope to search precipitates. It was confirmed that an intermetallic compound of $Sn_2Ni_3$ was uniformly dispersed in zirconium crystal grain of $\alpha$-phase. The precipitate was $Sn_2Ni_3$ and was ultra-fine in a degree of about 10 nm in particle size. The same microscopic observation was conducted on a test piece formed from a material of the same composition as the sample No. 34 but without the quench from $(\alpha+\beta)$ phase temperature. This test piece, however, showed no precipitate. It was confirmed also that the test piece of the same material quenched from $(\alpha+\beta)$ phase temperature does not have any Sn and Ni precipitate, after a hot plastic working effected after the quenching.

Embodiment 2

This embodiment relates to a process for producing a unclear fuel cladding tube for use in a nuclear reactor. Ingots were prepared by the arc-melting of five types of alloy materials having different alloy compositions shown in Table 2.

TABLE 2

| | Alloy Elements | | | | | |
|---|---|---|---|---|---|---|
| No. | Sn | Fe | Ni | Cr | Fe/Ni | Zr |
| 1 | 1.52 | 0.25 | 0.01 | 0.10 | 25 | bal. |
| 2 | 1.51 | 0.24 | 0.03 | 0.09 | 8 | " |
| 3 | 1.46 | 0.23 | 0.08 | 0.13 | 2.9 | " |
| 4 | 1.56 | 0.23 | 0.15 | 0.11 | 1.5 | " |
| 5 | 1.58 | 0.21 | 0.20 | 0.10 | 1.0 | " |

After vacuum arc melting conducted twice, each ingot was forged at 1050° C. and, after being cooled to room temperature. The ingot was then subjected to a solid solution treatment which comprises the steps of reheating the ingot up to 1000° C., holding the ingot at this temperature for 1 hour and cooling the same in water. After this solid solution treatment, the ingot was forged at 700° C., cooled and reheated up to 700° C. and annealed for 1 hour at this temperature. Then, the surface of the ingot was ground and coated with Cu, and the ingot was hot-extruded at 650° C. and thereafter the Cu coating was removed, whereby a tubular material known as a tube shell was formed. The tube shell thus formed had an outside diameter of 63.5 mm and wall thickness of 10.9 mm. The tube shell was made to pass through a high-frequency induction coil so as to be heated and was quenched by water sprayed from a water spray nozzle which was disposed on the downstream side of the path of the crude tube immediately rearward of the high-frequency induction heating coil. The maximum heating temperature was 910° C. at which the alloy has $(\alpha+\beta)$ phase. The crude tube was held at temperatures above 860° C. for 10 seconds. The cooling rate from 910° C. down to 500° C. was about 100° C. per second. The high-frequency quenched tube shell was then formed into the final size of the fuel cladding tube of 12.3 mm in outside diameter and 0.86 mm in wall thickness, through three repetitional cycles of treatment, each cycle having the steps of rolling by a Pilger mill and intermediate annealing.

The intermediate annealing in each treating cycle was conducted in vacuum of $10^{-5}$ torr. In the successive treating cycles, the intermediate annealing temperature was varied: namely 600° C. in the first treating cycle, 650° C. in the second treating cycle and 577° C. in the final treating cycle. The rolling operations in the first, second and the third treating cycles were conducted to effect reductions of areas of 77%, 77% and 70%, respectively. The alloy of the sample No. 5 shown in Table 2 exhibited microcracks during the repetitional three treating cycles, more specifically during the second cold rolling, so that subsequent workings were not effected on this sample. This suggests that the cold workability is undesirably lowered when Ni is added by amount in excess of 0.2 wt %. Immediately after the annealing, each sample of the tube shell had no oxide film thereon and showed colorless metallic luster.

The fuel cladding tubes thus formed were subjected to a tensile test conducted at room temperature and 343° C., as well as to a corrosion test, the result of which is shown in Table 3.

TABLE 3

| | Tensile Test at Room Temp. (25° C.) | | Tensile Test at High Temp.(343° C.) | | Corrosion | |
|---|---|---|---|---|---|---|
| No. | Tensile Strength (kg/mm²) | Elongation (%) | Tensile Strength (kg/mm²) | Elongation (%) | Weight Increment (mg/dm²) | Remarks |
| 1 | 58.2 | 34.2 | 28.2 | 45.3 | 112 | Low-Ni Alloy |
| 2 | 58.5 | 34.5 | 28.9 | 45.3 | 38 | Alloy of The Invention |
| 3 | 59.1 | 35.1 | 30.1 | 44.8 | 33 | Alloy of The Invention |
| 4 | 59.0 | 34.3 | 29.9 | 44.3 | 33 | Alloy of The Invention |

The tensile strength characteristics of the tube shell were substantially in the same degree regardless of the alloy compositions. It will be understood also that the corrosion resistance is insufficient when the Ni content is 0.01 wt % or less, and that, in order to obtain acceptable level of corrosion resistance, the Ni content should be 0.03 wt % or greater. The cladding tubes of sample Nos. 2 to 4, which showed superior corrosion resistance, had $Sn_2Ni_3$ intermetallic compound phase the particle size of which was about 0.01 $\mu$m and the intermetallic compound was uniformly dispersed in recrystallized Zr crystal grains of $\alpha$-phase.

Embodiment 3

Figure 6:
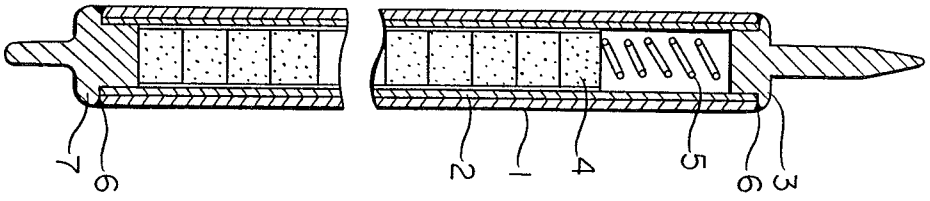
FIG. 6 is a sectional view of a fuel rod having parts made of an alloy prepared in accordance with the present invention.

Fuel rods as shown in FIG. 6 were produced by using the cladding tubes of the sample No. 4 in Embodiment 2, with terminal plugs being made of the same alloy as the cladding tube. The fuel rod thus produced was constituted by the cladding tube 1, liner 2, upper terminal plug 3, nuclear fuel pellets, e.g., $UO_2$, plenum spring 5, weldzone 6 and the lower terminal plug 7.

The terminal plugs were forged at the β-phase temperature region, followed by annealing, and were welded to the cladding tube 1 by TIG welding. The liner 2 was inserted in the tube shell of the Zr alloy prior to hot extrusion, and the liner tube and tube shell were bonded each other by the hot extrusion. After the hot extrusion, the extruded composite tube was locally heated from the outer periphery by high frequency induction heating means while water flowed in the tube. Immediately after the local heating, the heated outer periphery of the composite tube was cooled by water spraying and was quenched. Thereafter, both cold plastic working and annealing were effected three times. The resultant crude composite tube was rolled into the final thickness by subjecting the tube to the same repetitional treatment comprising alternating cold plastic working and annealing as in the process of producing the fuel cladding tube described in the Embodiment 2.

Figure 7:
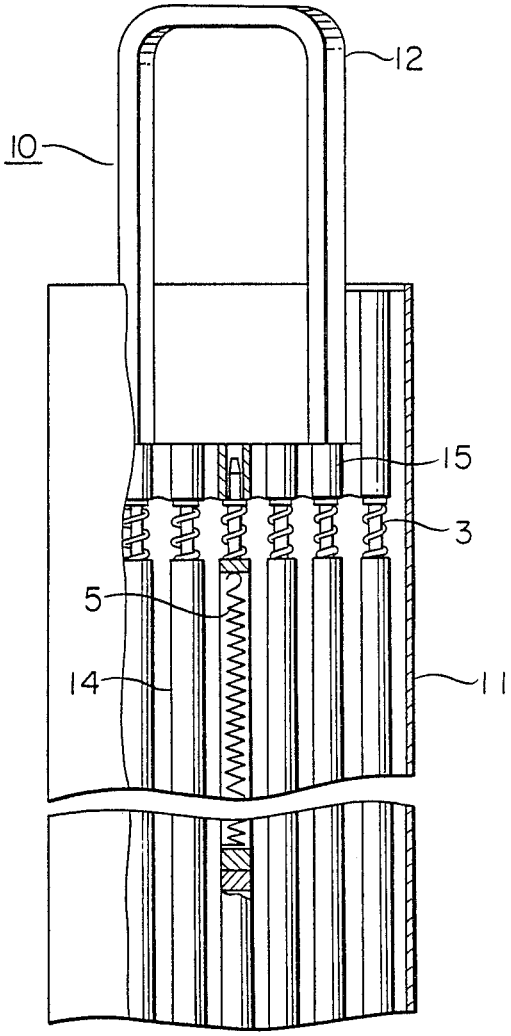
FIG. 7 is a fragmentary sectional view of a fuel assembly.

A plurality of fuel rods thus formed were assembled into a fuel assembly as shown in FIG. 7, which was then loaded in the core of a nuclear reactor. The fuel assembly 10 was constituted mainly by a channel box 11, fuel rods 14, handle 12, upper end plate 15 and a lower end plate (not shown).

According to the present invention, it is possible to obtain fuel cladding tubes and other members which exhibit superior corrosion resistance and reduced hydrogen absorption rate. In consequence, the reliability of these members are improved to remarkably extend their service life when used in nuclear reactors, while achieving a high degree of burn-up regarding a nuclear fuel.

Embodiment 4

The zirconium-based No. 4 alloy of Embodiment 2 was used for a fuel cladding pipe for a boiling-water reactor in accordance with the production steps illustrated in Table 4.

The production steps as far as the solid solution treatment were the same as those of the conventional process. After the solid solution treatment, the pipe was heated to 600° C. and was then subjected to α-forging. After heated to 600 ° C., the pipe was hot-extruded and thereafter the vacuum annealing at 600° C. and the rolling at room temperature were repeated three times. Recrystallization annealing (at about 580° C.) was carried out as the final annealing. Generally, the metal temperature rises during forging and extrusion, but the above-mentioned α-forging and hot extrusion temperatures of 600° C. were controlled so that the temperature did not exceed 640° C. even if the temperature did rise due to the forging and extrusion.

As a result of a corrosion test performed in the same way as in the aforementioned examples, the pipe was found to have an excellent corrosion resistance substantially comparable to the corrosion resistance of the alloy of the present invention of Example 3. The other properties were also substantially the same as those of the pipe of the alloy of the present invention of Example 3.

TABLE 4

| Step No. | Step | Temperature condition |
|---|---|---|
| (1) | Melting | (Arc melting) |
| (2) | β-forging | 1,000° C. |

TABLE 4-continued

| Step No. | Step | Temperature condition |
|---|---|---|
| (3) | Solid solution treatment | 1,020–1,050° C. |
| (4) | α-forging | 600° C. |
| (5) | Machining | Room temperature |
| (6) | Hot extrusion | 600° C. |
| (7) | Annealing | 600° C. |
| (8) | Rolling (lst) | Room temperature |
| (9) | Annealing | 600° C. |
| (10) | Rolling (2nd) | Room temperature |
| (11) | Annealing | 600° C. |
| (12) | Rolling (3rd) | Room temperature |
| (13) | Final annealing | 580° C. |

What is claimed is:

1. A nuclear fuel rod with a high corrosion resistance, comprising a nuclear fuel cladding tube made of a zirconium-based alloy, fuel pellets received in said cladding tube and terminal plugs welded to both ends of said cladding tube, the interior of said cladding tube closed by said terminal plugs being filled with an inert gas, said zirconium alloy consisting essentailly of 1 to 2 wt % Sn, 0.20 to 0.35 wt % Fe, 0.03 to 0.16 wt % Ni, not more than 0.15 wt % Cr, and the balance substantially Zr, and Fe/Ni content ratio ranging between 1.4 and 8 and a total amount of Fe+Ni of not less than 0.24 wt %; said alloy having been subjected to a treatment including hot plastic working and after a final hot plastic working to a treatment in which said alloy is held for a short time at a temperature at which α-phase and β-phase coexist or at which β-phase exists and then quenched and thereafter said alloy being subjected to repetitional treating cycles each comprising a cold plastic working and annealing.

2. A nuclear fuel rod as claimed in claim 1, wherein fine intermetallic compound of Sn and Ni being precipitated within the zirconium crystal grain of α-phase.

3. A nuclear fuel rod with a high corrosion resistance, comprising a nuclear fuel cladding tube made of a zirconium-based alloy, a pure zirconium liner fitted on inner side of said cladding tube, fuel pellets received in said cladding tube and terminal plugs welded to both ends of said cladding tube, the interior of said cladding tube closed by said terminal plugs being filled with an inert gas, said zirconium alloy consisting essentailly of 1 to 2 wt % Sn, 0.20 to 0.35 wt % Fe, 0.03 to 0.16 wt % Ni, 0.05 to 0.15 wt % Cr and the balance substantially Zr, a Fe/Ni content ratio ranging between 1.4 and 8 total amount of Fe+Ni of not less than 0.24 wt %; said alloy having been subjected to a treatment including hot plastic working and after a final hot plastic working to a treatment in which said alloy is held for a short time at a temperature at which α-phase and β-phase coexist or at which β-phase exists and then quenched and thereafter said alloy being subjected to repetitional treating cycles each comprising a cold plastic working and annealing.

4. A nuclear fuel rod as claimed in claim 3, wherein a fine intermetallic compound of Sn and Ni having pa particle size not greater than 0.2 μm and an inter-metallic compound of Fe, Ni, and Zr having a particle size ranging between 0.1 and 0.5 μm are precipitated within the zirconium crystal grain of α-phase.

5. A nuclear fuel assembly for use in a nuclear reactor having a plurality of fuel rods, upper and lower tie-plates holding the upper and lower ends of said fuel rods, spacers disposed between said upper and lower tie-plates and adapted for providing a predetermined pitch of arrangement of said fuel rods, a channel box having a polygonal cylinder shape and accommodating said fuel rods, upper and lower tie-plates and spacers, and a handle provided on said upper tie-plate so as to enable the whole of said fuel rod to be handled and transported as a unit, wherein each of said fuel rods including a fuel cladding tube made of a zirconium-based alloy and receiving therein nuclear fuel pellets, said zirconium alloy consisting essentailly of 1 to 2 wt % Sn, 0.20 to 0.35 wt % Fe, 0.03 to 0.16 wt % Ni, not more than 0.15 wt % Cr and the balance substantially Zr, a Fe/Ni content ratio ranging between 1.4 and 8 and a total amount of Fe+Ni of not less than 0.24 wt %; said alloy having been subjected to a treatment including hot plastic working and after a final hot plastic working to a treatment in which said alloy is held for a short time at a temperature at which $\alpha$-phase and $\beta$-phase coexist or at which $\beta$-phase exists and then quenched and thereafter said alloy being subjected to repetitional treating cycles each comprising a cold plastic working and annealing.

6. A nuclear fuel assembly as claimed in claim 5, wherein fine intermetallic compound of Sn and Ni is precipitated within the zirconium cyrstal grain of $\alpha$-phase.

7. A nuclear fuel assembly for use in a nuclear reactor having a plurality of fuel rods, upper and lower tie-plates holding the upper and lower tie-plates and adapted for providing a predetermined pitch of arrangement of said fuel rods, a channel box having a polygonal cylinder shape and accommodating said fuel rods, upper and lower tie-plates and spacers, and a handle provided on said upper tie-plate so as to enable the whole of said fuel rod to be handled and transported as a unit, wherein each of said fuel rods including a fuel cladding tube made of a zirconium-based alloy and receiving therein nuclear fuel pellets, said zirconium alloy consisting essentially of 1 to 2 wt % Sn, 0.20 to 0.35 wt % Fe, 0.03 to 0.16 wt % Ni, 0.05 to 0.15 wt % Cr and the balance substantially Zr, a Fe/Ni content ratio ranging between 1.4 and 8 and total amount of Fe+Ni of not less than 0.24 wt %; said alloy having been subjected to a treatment including hot plastic working and after a final hot plastic working to a treatment in which said alloy is held for a short time at a temperature at which $\alpha$-phase and $\beta$-phase coexist or at which $\beta$-phase exists and then quenched and thereafter said alloy being subjected to repetitional treating cycles each comprising a cold plastic working and annealing.

8. A nuclear fuel assembly as claimed in claim 7, wherein fine intermetallic compound of Sn and Ni having a particle size of not greater than 0.2 $\mu$m and intermetallic compound of Fe, Ni and Zr having a particle size ranging between 0.1 and 0.5 $\mu$m being precipitated within the zirconium cyrstal grain of $\alpha$-phase.

* * * * *